United States Patent [19]

Cassoli

[11] Patent Number: 4,854,108

[45] Date of Patent: Aug. 8, 1989

[54] AUTOMATIC WRAPPING MACHINE

[75] Inventor: Paolo Cassoli, Casalecchio di Reno, Italy

[73] Assignee: Cassoli Macchine Automatiche Confezionatrici S.r.l., Casalecchio di Reno, Italy

[21] Appl. No.: 193,078

[22] Filed: May 12, 1988

[30] Foreign Application Priority Data

May 20, 1987 [IT] Italy ..... 12490 A/87

[51] Int. Cl.[4] ..... B65B 11/22

[52] U.S. Cl. ..... 53/209; 53/228; 53/232

[58] Field of Search ..... 53/209, 228, 230, 231, 53/232, 233

[56] References Cited

U.S. PATENT DOCUMENTS

| | | | |
|---|---|---|---|
| 2,146,997 | 2/1939 | Smith | 53/230 |
| 2,243,633 | 5/1941 | Jones | 53/232 X |
| 3,338,026 | 8/1967 | Billi | 53/233 |
| 3,844,088 | 10/1974 | McDonough | 53/389 X |
| 4,624,096 | 11/1986 | Nordsrom | 53/209 |

FOREIGN PATENT DOCUMENTS

| | | | |
|---|---|---|---|
| 978076 | 11/1975 | Canada | 53/209 |

*Primary Examiner*—John Sipos

*Attorney, Agent, or Firm*—Larson & Taylor

[57] ABSTRACT

An automatic, continuous-cycle machine adapted for the wrapping of products consisting of groups of paper rolls, in which the product (P) is conveyed along a longitudinal path of travel and a wrapping sheet (15) in positioned thereon, said sheet being severed from a continuous ribbon which is unwound from a reel (21). The wrapper sheet is folded into tubular shape on the product, with partial overlapping of its edges (115-215) on the bottom of said product, and continuous sealing of said overlapped edges is then effected. Successively, the product with the tubular wrapper is rotated 90° about a vertical axis, so that the portions of said wrapper which are still open are subjected to the action of final folding and sealing members.

6 Claims, 5 Drawing Sheets

AUTOMATIC WRAPPING MACHINE

The invention relates to an automatic, continuous-cycle, high output machine, particularly adapted to wrap, by means of a film or any other heat-sealable material unwound from a single reel, rolls of toilet paper, household paper, or paper for other uses.

The characteristics of the machine of the invention and the advantages resulting therefrom will become apparent from the following description of a preferred, but not exclusive, embodiment thereof, shown merely as a non-limiting example in the Figures of the accompanying five sheets of drawings, in which.

Figure 1:
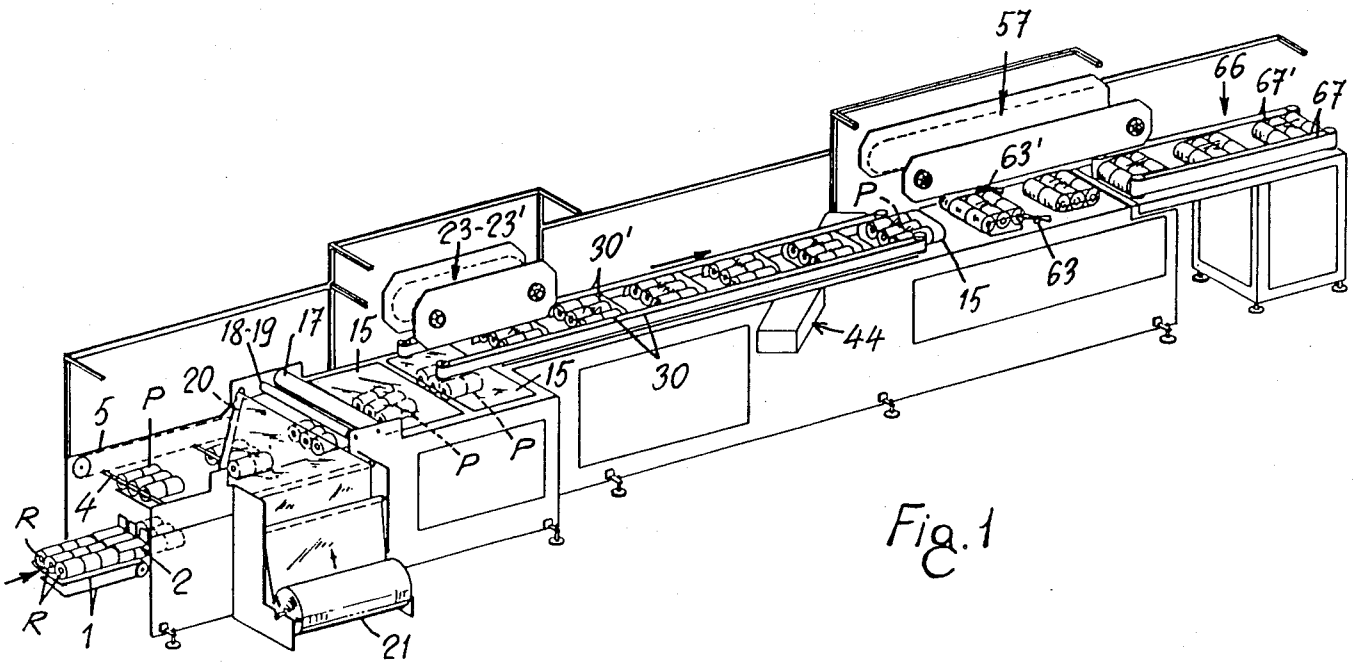
FIG. 1 is a diagrammatic perspective view of the machine.
Figure 2:
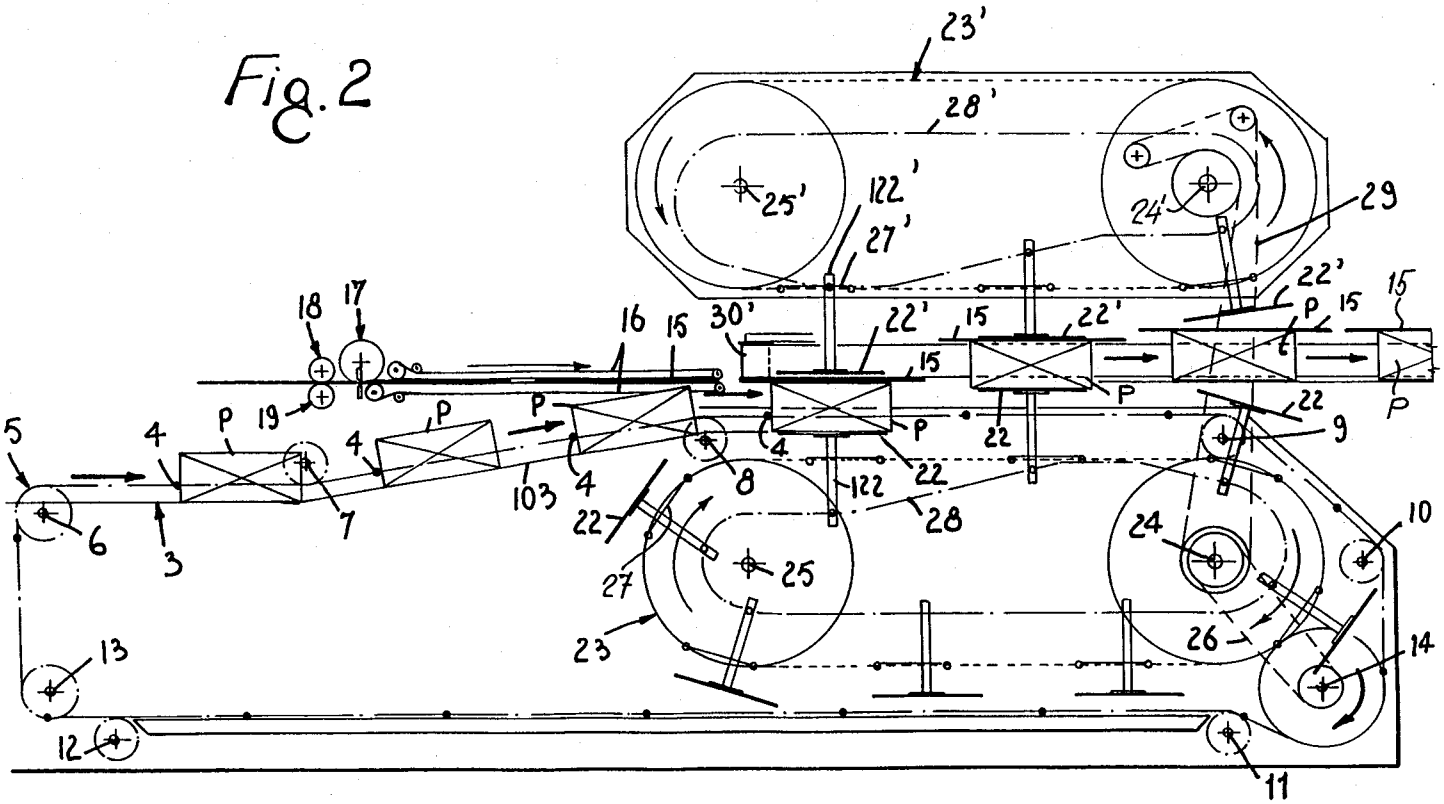
FIG. 2 is a diagrammatic side elevational view, with more details, of the first portion of the machine which positions a stretch of film on each product and which introduces said product with said film into the line for the tubular-shaping and bottom-longitudinal sealing of said wrapping film.

With reference first to FIG. 1, it will be noted that the rolls of paper R to be wrapped are fed by a conveyor 1 on which said rolls are for example aligned in one or more rows and are disposed with their axes in the direction of their movement. By the action of means 2 of any known type, a pre-established group of rolls, which will be called simply "the product P" hereinafter, is raised and laid down, with said orientation, onto the initial portion of a support and guide structure 3 having an ascending stretch as indicated at 103.

With a proper timing, the product P is pushed from behind and is advanced on the structure 3 by one of the cross bars 4 of a parallel-chains conveyor 5 which is operated in timed relation with said means 2, passed around the shafts 6-7-8-9-10-11-12-13 and driven by the shaft 14.

While traveling on the ascending stretch 103, the product is suitably positioned below a sheet of heat-sealable film 15 transported laterally by pairs of powered belts 16 and coming from cyclical-cutting means 17 which act transversely on the endless film supplied thereto by a pair of parallel driving rollers 18-19 also suitably powered. Upstream of the means 18-19, said film is turned 90° around a fixed or stationary device 20 and comes from a reel 21 which, together with its compensation and controlled-unwinding means, is arranged at one side of the machine and in such a position as to be easily set in place.

At the end of the ascending stretch 103, the product P is covered by the wrapping sheet 15 which, preferably, is still held by the belts 16 which are advanced with an equal horizontal component as said product, so as to prevent said sheet from assuming an improper position.

Upon leaving the ascending stretch 103, the product P is laid down onto one of the elevators 22 which are carried equally spaced from each other by a parallel-chains conveyor 23 which is passed around the shafts 24-25 and is connected kinematically at 26 to the conveyor 5 so as to move in timed relation therewith. More particularly, on the conveyor 23 there are secured the guides 27 carrying the elevators 22 which, through roller means associated with their stems 122, co-operate with a stationary cam 28.

Figure 4:
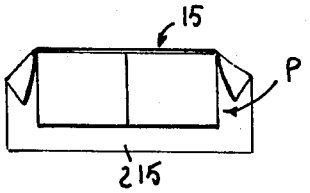
FIG. 4 shows the product with the wrapping film, on the section line IV—IV of FIG. 3.
Figure 3:
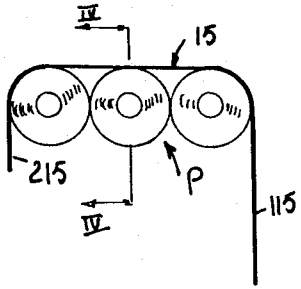
FIG. 3 shows a detail in transverse section of the product with the wrapping film.

In opposition to the conveyor and kinematically connected thereto as indicated, for example, at 29 there is provided a similar conveyor 23' which is passed around the shafts 24'-25' and is provided with counter-elevators 22' carried by guides 27' and co-operating through their stems 122' with a stationary cam 28', the arrangement being such that when the product P leaves the ascending stretch 103, it will be firmly held, together with the wrapping sheet 15, between an elevator 22 and a counter-elevator 22'. During this step, the wrapping film 15 no longer co-operates with the conveyor belts 16, whereby the portions or flaps thereof projecting from the plan view outline of the product P will fall down on the perimeter of said product, as shown in the detail views of FIGS. 3 and 4.

The cams 28-28' have such as outline whereby while the assembly P-15 is advanced, it is also progressively raised, moved off the cross bar 4 of the conveyor 5 and then maintained at a pre-established level and advanced only along the horizontal component.

When the assembly P-15 is raised by the members 22-22', it is inserted between two pairs of belts (or equivalent means) 30-30' and 31-31' (see also FIGS. 5 and 6–10), the former being of the planar or flat type while the latter are of the round-section type. The numerals 32-33-34-35 and 32'-33'-34' -35' indicate the vertical-axis turnaround pulleys for the flat belts 30-30', while the numerals 36-36' indicate the pulleys for actuating both these belts and the belts 31-31' which are passed around the vertical-axis pulleys 37-38-39-35 and 37'-38'-39'-35', respectively.

The inner stretches of the belts 30-30', at the initial portion of their operative travel, are not restrained by the inner stationary guides 40-40' (FIG. 6), said guides beginning substantially together with the belts 31-31' and granting said inner stretches a parallel positioning and a proper spacing apart that is suitably smaller than the width of the product P to be wrapped. Said initial portion of the inner stretches of the belts 30-30' is characterized by a slight divergence towards the left-hand side of an observer looking at FIG. 5, whereby the assembly P-15 may be raised and inserted between these belts with no excessive and detrimental friction between said belts and the drooping side flaps of the film 15.

Figure 6:
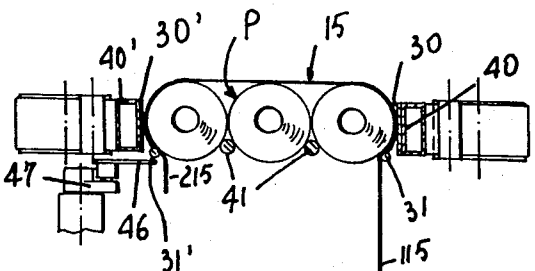

When the assembly P-15 has been duly raised between the belts 30-30', the inner stretches of these belts, under the action of said guides 40-40', being exerting a proper pressure against the sides of said assembly which, under the action of the unit 22-22' is advanced by only a horizontal component at the same speed as said belts 30-30'. During this step, the product P is passed onto stationary guides 41 arranged longitudinally in a symmetrical position between the belts 30-30' and (as shown in the detail of FIG. 6) disposed in the lower empty spaces between the rolls constituting the product P. The guides 41 are supported by underlying transoms 42 which are arranged only at the intermediate portion of said guides, said guides being, therefore, overhung at the initial and the final portions thereof, in the first case to avoid interfering with the elevator 22, and in the second case to avoid interfering with the means will shape in tubular manner the wrapping film 15 onto the product and then to avoid interfering with the tubular-shaped film.

When the product P is released from the elevator 22 and counter-elevator 22', it will be supported by the guides 41 and moreover by the belts 31-31', which progressively get closer below the sides of said product for the additional purpose to properly wrap thereon the flaps of the wrapping sheet 15 (FIG. 6). The belts 31-31' are advanced at the same speed as the side belts 30-30' which advance the assembly P-15 on said guides 41.

The belts 30-30' are constructed of any material and/or shape such that the outer surface thereof has a high friction coefficient in the contact with the product to be packaged.

Figure 5:
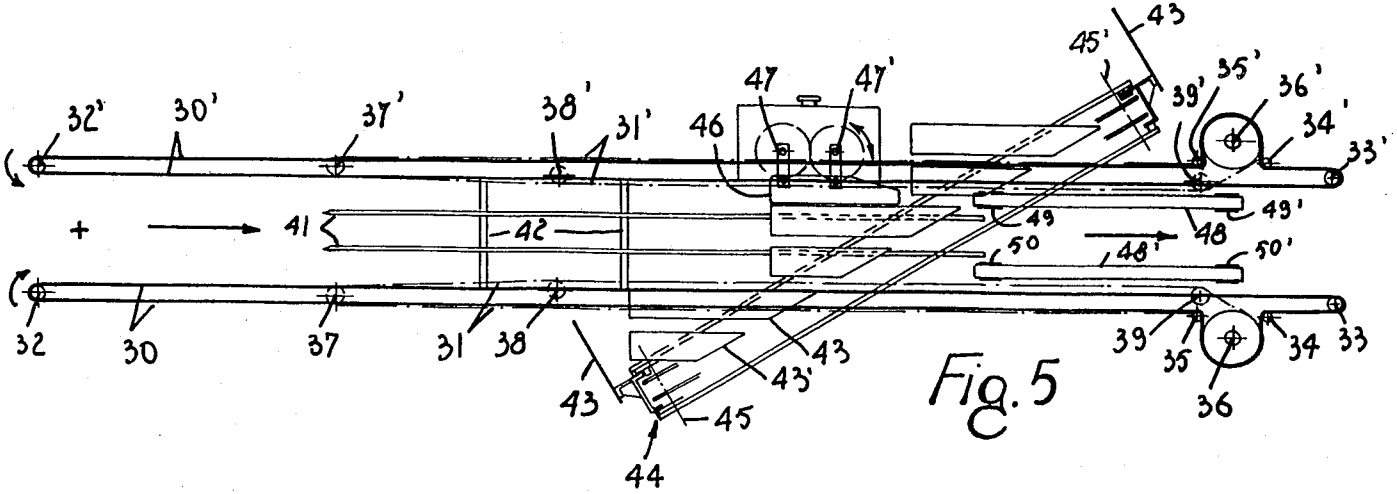
FIG. 5 is a diagrammatic top plan view of the assembly of members for tubular-shaping and for longitudinally sealing the wrapping film.
Figure 7:
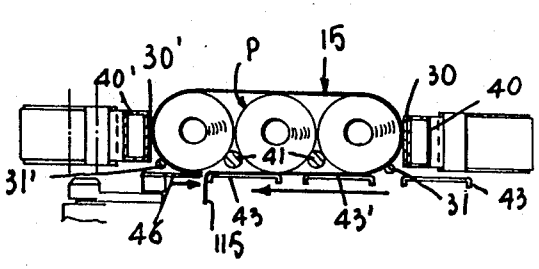
FIGS. 6, 7, 8 and 9 are cross sectional views of the operational assembly of FIG. 5 during successive tubular-shaping and longitudinal sealing steps of the wrapping film.
Figure 9:
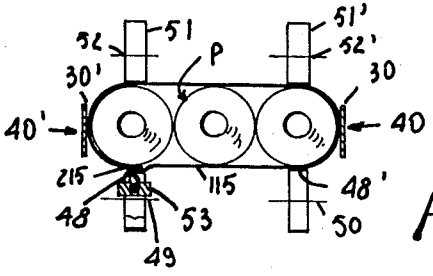
Figure 8:
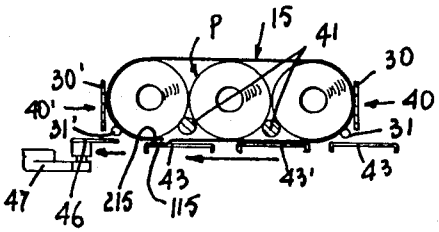

With reference to FIGS. 5–7, it will be noted that during the advance on the guides 41, the longer side flap 115 of the wrapping sheet covering the product P is spread onto the bottom of said product by the combined action of one of the pairs of planar and co-planar paddles 43-43' carried in cantilever fashion and equally spaced apart on a chain conveyor 44 which is arranged with a suitable inclination below the belts 30-30'-31-31' and which is connected kinematically with said belts so as to travel in timed relation therewith. The numerals 45-45' indicate the turnaround shafts of said conveyor 44. Again in FIGS. 5 and 7, it will be noted that before the flap 115 is completely lifted by the paddles 43-43', an opposite stationary paddle 46 actuated, for example, by a vertical-axis double crank device 47-47' connected in a suitable timed relation with the conveyor 44, spreads the shorter flap 215 of the film 15 onto the bottom of the product P, and then said last-mentioned paddle is retracted in timed relation with the advance of the paddles 43-43', so that the flap 115 will overlap the flap 215, as seen in the sequence of FIGS. 7 and 8.

While supported by the longer paddle 43 (FIG. 5), the portion of wrapping film with the overlapped flaps 115-215 is passed onto a belt 48 of a pair of parallel belts 48-48' which take over in supporting the assembly P-15 and which are passed around the horizontal shafts 49-50-49'-50' which are perpendicular to the belts 30-30'. In opposition to the belts 48-48', as shown in the detail view of FIG. 9, there are operatively arranged corresponding and similar belts 51-51' which are synchronized with the lower belts so as to travel with their inner stretches in engagement with the product, at the same speed as the side belts 30-30'. The numerals 52-52' indicate two of the turnround shafts for the upper belts 51-51'.

Figure 10:
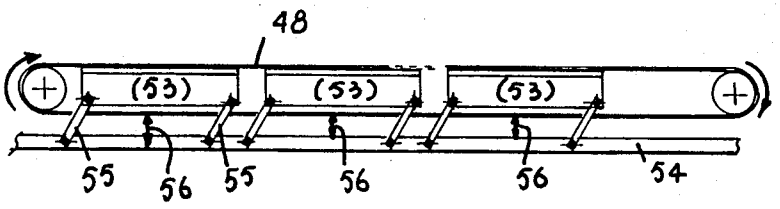
FIG. 10 is a diagrammatic side elevational view of the continuous heat-sealing units used in the machine of the invention.

The belt 48 which engages the superposed portions of the flaps 115-215 of the wrapping film is a part of a continuous heat-sealing apparatus which secures said flaps to each other and which is of known construction. Preferably, as shown in the detail of FIG. 10, at least the belt 48 is made of Teflon or any other suitable material and its upper flight is heated by a bank of thermostat-controlled elements 53 connected to a stationary supporting structure 54, for example, through parallelogram links 55 so as to be movable towards and away with respect to said flight under the action of suitable servo-controls, diagrammatically shown by the arrows 56 and constituted, for example, by fluid-operated cylinder-and-piston units. This solution enables the activation and disactivation of a number of heating elements depending upon the operative speed of the machine and/or upon the characteristics of the film used for the formation of the wrapper, while said elements are always maintained at the operational temperature and, therefore, always ready to be used.

Turning back to FIG. 1, it will be noted that upon leaving the sealing station of the tubular shaped wrapper, the assembly P-15 reaches a station 57 which, while supporting said assembly and advancing it in time relationship with the preceding stations of the machine, imparts said assembly a 90° rotation about a vertical axis, so that the still opened ends of the wrapper will be disposed laterally in the successive path of travel of said assembly and, therefore, they may be closed and sealed by known means.

Figure 11:
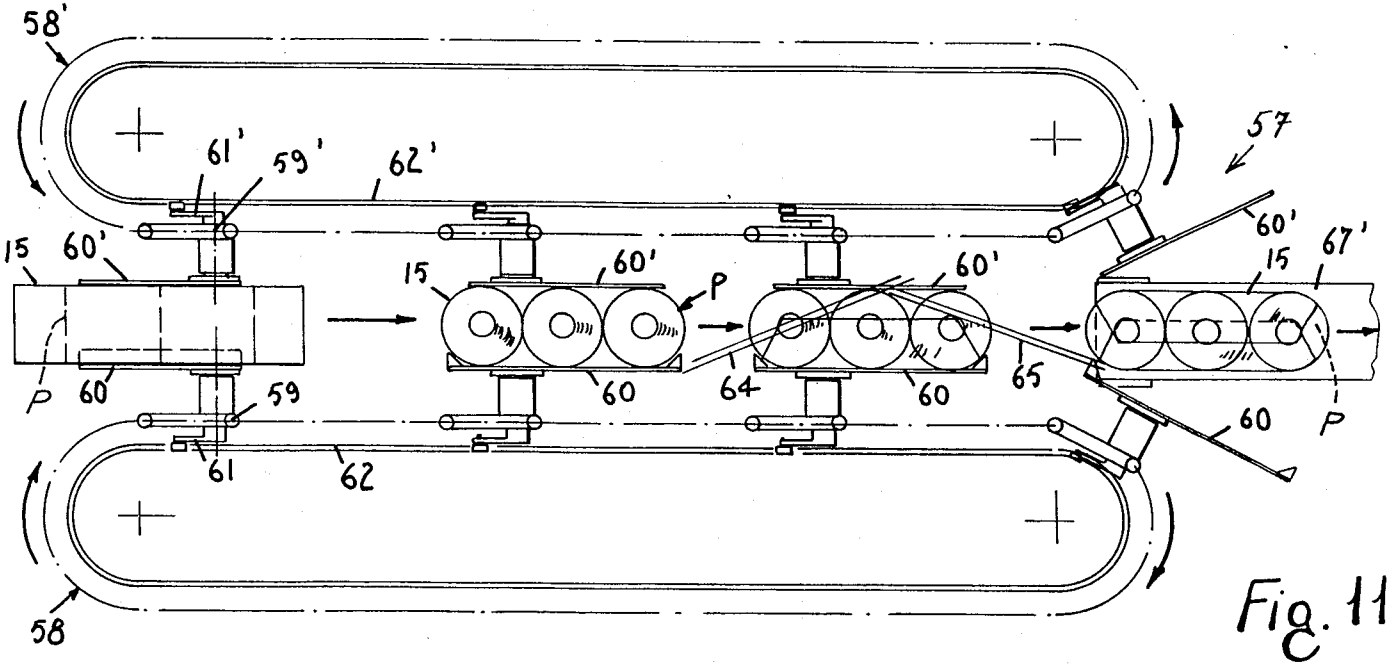
FIG. 11 is a diagrammatic side view of the operational unit for rotating 90° about a vertical axis the partly wrapped product coming from the means of FIG. 3, to position the wrapper for final closing and for sealing by the action of opposite means which operate in line with those of said FIG. 3.

FIG. 11 shows in detail a possible embodiment of said station 57. This station comprises two superposed, parallel-chains conveyors 58-58' which are synchronized to each other and comprise guide bodies 59-59' suitably equispaced apart and rotatably supporting the rotation shafts of trays 60 and counter-trays 60' whose orientation may be changed by the co-operation of levers 61-61' with stationary cams 62-62'. Upon leaving the longitudinal welding station of FIG. 9, the assembly P-15 is timely laid down into a tray 60 and is immediately clamped thereon by a counter-tray 60'. While travelling with the inner opposite flights of the conveyors 58-58', the units 60-60' are rotated of 90° about the vertical, so as to change the orientation of the assembly P-15. At the station 57 there are provided movable folding members 63-63' (FIG. 1) and stationary folding members 64-65 (FIG. 11), of conventional type, which close the still opened ends of the wrapping film, so as to position them with overlapping portions that may be then heat-sealed at a successive station 66 (FIG. 1) comprising a pair of powered, parallelly opposite belts 67-67', which are provided with heating elements similar to those described with reference to FIG. 10.

It is to be understood that contrarily to what has been described and shown, the station 57 of FIG. 11 may be omitted if the last portion of the wrapping cycle is effected on a line which is at 90° to the line from which there is issued the product wrapped in the packaging film which has been tubular-shaped and sealed longitudinally. The constructional details of such a modified embodiment are not illustrated here, in that they may be conceived and carried out easily by those skilled in the art.

Finally, it is to be understood that the machine may be used for the packaging of articles other than paper rolls, and that many changes and modifications, especially of constructional nature, may be made to said machine. The machine may be adapted for the use of wrapping material which is not heat-sealable, and in this instance it will be equipped with glueing and pressing devices.

I claim:

1. A machine for wrapping products (P) consisting of a plurality of cylindrical articles (R), comprising:

first feeding means (1-2) of feeding the product (P) to a first conveyor (3-103-4-5) which moves the product in a longitudinal direction substantially coinciding with the longitudinal axis of the articles (R) and which delivers the product (P) onto elevator and counter-elevator means (22-22') for raising the the product therefrom;

wrapper feeding means (16) for feeding a wrapper sheet (15) in the longitudinal direction above the product carried by said first conveyor (3-5) so that said product (P) is delivered to said elevator and counter-elevator means with the wrapper sheet (15) positioned thereon, said wrapper sheet (15) presented side flaps (115, 215) drooping at sides of the product;

a guide channel (30-31-30'-31') receiving the product and wrapper sheet (P, 15) from said elevator and counter-elevator means (22-22'), and continuing the advancing movement of same in the longitudinal direction, said guide channel presenting lower fixed guide members (41) for correctly supporting the product (P);

first folding means (43-43'-46) for folding the wrapper side flaps (115-215) onto a bottom of the product (P) causing the superposition of edges of said side flaps;

first sealing means (53) for sealing together the superposed edges of the side flaps (115-215), thus giving origin to a tubular shaped open ended wrapper enclosing the product (P);

rotating means (59-60-61) for imparting to the product enclosed in the tubular shaped open ended wrapper a 90° rotation, and for continuing its advancement in the longitudinal direction, so as to subject open ends of the tubular wrapper to the action of a second folding means (63-64-65) and a second sealing means (66-67);

said first feeding means comprising a guide (3) presenting an ascending stretch (103), such that into an initial portion of said guide a suitable means (1-2) feeds cyclically the product (P) which is timely engaged by one of a plurality of cross bars (4) of a parallel-chains conveyor (5) which carries said product longitudinally along said guide;

said wrapper feeding means comprising opposite feeding belts (16) which transport, longitudinally and above the product being advanced on said guide (3), the wrapper sheet (15) having been severed by cutting means (17) from a film unwound from a reel (21), in such a manner that at an end of the ascending stretch (103), the wrapper sheet is suitably positioned on said product and is held laterally by said opposite feeding belts (16);

said elevator (22) and counter-elevator (22') means being provided at the end of the ascending stretch (103), whereby the product (P) is positioned on an elevator (22) thereof and is held thereon by a counter-elevator (22') thereof which timely clamps on said product the wrapping sheet (15) released by the opposite feeding belts and whose side flaps hang down on a perimeter of said product, which product is progressively raised by the elevator and counter-elevator acting as a unit and which is introduced into said guide channel which is aligned longitudinally, whereafter said elevator/counter-elevator unit is deactivated and repeats a new working cycle;

said guide channel comprising a pair of moving lateral flat belts (30-30') having an outer face with high-friction coefficient, and comprising at its sides a pair of moving round-section lateral lower belts (31-31') which progressively are inserted below the product, these lateral lower belts being synchronized with the lateral flat belts, and said guide channel being provided at its bottom with stationary, round-sectioned said guide members (41) parallel to said lateral flat and lateral lower belts, which said lateral flat and lateral lower belts engage the product in lower empty spaces between the adjacent cylindrical articles and which are mounted so that end portions thereof are overhanging to avoid interfering with the elevator (22) and to avoid interfering thereafter with the first folding means which act on the wrapping sheet;

said first folding means (43-43'-46) acts below the product moving along said guide channel and spreads the opposite side flaps (115-215) of the wrapping sheet onto the bottom of said product, so as to superpose said side flaps and to form the tubular shaped wrapper;

said first sealing means comprising opposite pairs of opposite upper and lower conveyor belts (48-48'-51-51') acting on the product as it leaves said lower guide members (41) and is still held laterally by the lateral flat and lateral lower conveyor belts (30-30'-31-31'), a lower portion and an upper portion of the product with the tubular shaped wrapper being engaged by said opposite pairs of said opposite upper and lower belts (48-48'-51-51') which travel in the same direction and at the same speed as said lateral belts, one of said opposite lower belts being arranged so as to engage the superposed flaps of the tubular-shaped wrapper, being made of suitable heat-transmitting material, and being urged against said sheet by heating means (53) which effect the continuous heat-sealing of said superposed flaps; and said rotating means comprising a station (57) which takes over the product thus sealed in a tubular open ended wrapper and which, while advancing it in the original longitudinal direction of travel, causes its rotation 90° about a vertical axis, to subject the open ends of the tubular wrapper to the action of said second folding means, (63-63'-64-65) and of said second sealing means (67-67') to finally close the said open ends of the tubular wrapper.

2. A wrapping machine according to claim 1, in which there are a plurality of said elevators (22) and counter-elevators (22') which are associated, equally spaced apart and in a suitable number, with opposite elevator conveyor means (23-23') comprising stationary cams (28-28') for raising and lowering said elevators and counter-elevators (22-22') which by said respective opposite elevator conveyor means are moved continuously and synchronously with the product to be wrapped.

3. A wrapping machine according to claim 1, in which the wrapper feeding means for positioning the wrapping sheet (15) onto the product (P) operates such that when said sheet has been laid down onto said product, said sheet presents one side flap (115) which is much longer than the opposite side flap (215), whereby the overlapping of the end portions of said flaps on the bottom of the product occurs at a short distance from one of the sides of said product.

4. A wrapping machine according to claim 3, in which the first folding means for spreading the side flaps (115-215) onto the bottom of the product and for superposing the end portions of said flaps comprise pairs of paddles (43-43') mounted on a rectilinear conveyor (44) which traverses in a complete manner and with a suitable inclination the bottom of the guide channel (30-30'-31-31'-41) in which the product with the wrapping sheet is advanced, the arrangement being such that said paddles interfere with a perpendicular component against the one longer side flap (115) and spreads it perfectly onto the bottom of the product while the other shorter side flap (215) is folded by a paddle (46) carried by a pivotable actuating device (47-47'), in such a manner that the end portion of the other shorter side flap is located under the end portion of the one longer side flap.

5. A wrapping machine according to claim 1, in which said first sealing means and said second sealing means for effecting the continuous sealing of the wrapper comprise sets of heating elements (53) which are permanently heated and which, depending on the working speed of the machine and/or the characteristics of the film used for making the wrapper, are adjustably movable between a position engaged with and a position spaced from the active flight of the one of said opposite lower belts and a belt associated with said second sealing means.

6. A wrapping machine according to claim 1, in which said rotation means includes trays (60) and counter-trays (60') which receive the product partially wrapped with the tubular open ended wrapper and which then submit said product to a 90° rotation about a vertical axis to transfer it to said second folding means and said second sealing means for the open ends of said tubular wrapper, said trays and counter-trays being associated with opposite tray conveyors (57-57') synchronized with each other and provided with stationary cams (62-62') which engage said trays and counter-trays to effect the 90° rotation.

* * * * *